US010847886B2

(12) United States Patent
Mak et al.

(10) Patent No.: US 10,847,886 B2
(45) Date of Patent: Nov. 24, 2020

(54) NEAR FIELD COMMUNICATION (NFC) TAG

(71) Applicant: Hong Kong R&D Centre for Logistics and Supply Chain Management Enabling Technologies Limited, Pok Fu Lam (HK)

(72) Inventors: Chilun Mak, Pok Fu Lam (HK); Jingtian Xi, Pok Fu Lam (HK); Chunwai Leung, Pok Fu Lam (HK)

(73) Assignee: Hong Kong R&D Centre for Logistics and Supply Chai, Pok Fu Lam (HK)

( * ) Notice: Subject to any disclaimer, the term of this patent is extended or adjusted under 35 U.S.C. 154(b) by 84 days.

(21) Appl. No.: 15/515,379

(22) PCT Filed: Sep. 30, 2014

(86) PCT No.: PCT/CN2014/087930
§ 371 (c)(1),
(2) Date: Mar. 29, 2017

(87) PCT Pub. No.: WO2016/049847
PCT Pub. Date: Apr. 7, 2016

(65) Prior Publication Data
US 2017/0244167 A1 Aug. 24, 2017

(51) Int. Cl.
*H01Q 7/00* (2006.01)
*H01Q 1/22* (2006.01)

(52) U.S. Cl.
CPC ..... *H01Q 7/00* (2013.01); *H01Q 1/2225* (2013.01)

(58) Field of Classification Search
CPC ..... H01Q 1/2225; H01Q 7/00; H01Q 7/005; H01Q 7/02; H01Q 7/04; H01Q 7/06; H01Q 7/08
See application file for complete search history.

(56) References Cited

U.S. PATENT DOCUMENTS

| | | | | |
|---|---|---|---|---|
| 6,208,235 | B1 * | 3/2001 | Trontelj | G06K 19/0723 340/10.1 |
| 2009/0108974 | A1 * | 4/2009 | Raggam | G06K 19/07749 336/105 |
| 2011/0065383 | A1 * | 3/2011 | Frankland | H01Q 7/00 455/41.1 |
| 2013/0146671 | A1 * | 6/2013 | Grieshofer | G06K 19/07794 235/492 |
| 2013/0154383 | A1 | 6/2013 | Kasturi et al. | |
| 2013/0181875 | A1 | 7/2013 | Charrat | |
| 2015/0130291 | A1 * | 5/2015 | Lim | H01Q 1/2225 307/104 |
| 2017/0040691 | A1 * | 2/2017 | Singh | H02J 7/025 |

FOREIGN PATENT DOCUMENTS

| | | | | |
|---|---|---|---|---|
| CN | 102299407 | A | 12/2011 | |
| CN | 103413256 | A | 11/2013 | |
| CN | 103714497 | A | 4/2014 | |
| JP | 2003085519 | A * | 3/2003 | G06K 19/07796 |

* cited by examiner

*Primary Examiner* — Daniel Munoz
(74) *Attorney, Agent, or Firm* — Renner Kenner Greive Bobak Taylor & Weber

(57) ABSTRACT

A near field communication (NFC) tag including an antenna having an inner loop portion coupled with an outer loop portion, and an integrated circuit chip attached to the inner loop portion or outer loop portion of the antenna; wherein the inner and outer loop portions of the antenna are arranged to increase a coupling range of the tag with an external tag reader.

11 Claims, 4 Drawing Sheets

NEAR FIELD COMMUNICATION (NFC) TAG

TECHNICAL FIELD

The present invention relates to a near field communication (NFC) tag antenna and particularly, although not exclusively, to a near field communication (NFC) tag having an antenna with inner and outer loop portions to provide improved coverage and range.

BACKGROUND

Near field communication (NFC) technologies belong to a wireless communication technology for the transfer of information. In a near field communication there typically comprise a NFC tag and a NFC reader. The NFC tag includes an antenna and a chip with a circuit module for storing information, but with no power source. The NFC reader is operable to read information stored in the circuit module of the tag, by transmitting electromagnetic power and command signals to the tag. The antenna of the NFC tag, upon receiving the signals, would power up the chip and retrieve the information from the circuit and transmit it back to the tag reader.

Near field communication technologies typically only has an operation range of a few centimetres. This means that the NFC tag and the NFC reader has to place almost immediately next to each other to enable the communication signals to be communicated between the tag and the reader. Often times, this short communication range is further hampered by the presence of interference in the operation environment. Apparently, there is a need for providing a more reliable and more versatile NFC tag and tag reader coupling means.

Some embodiments of the present invention address the above needs, overcome or substantially ameliorate the above disadvantages or, more generally, provide an improved NFC tag.

SUMMARY OF THE INVENTION

In accordance with a first aspect of the present invention, there is provided a near field communication (NFC) tag comprising an antenna having an inner loop portion coupled with an outer loop portion, and an integrated circuit chip attached to the inner loop portion or outer loop portion of the antenna; wherein the inner and outer loop portions of the antenna are arranged to increase a coupling range of the tag with an external tag reader.

In one embodiment of the first aspect, the inner loop portion and the outer loop portion respectively include one or more turns.

In one embodiment of the first aspect, the one or more turns of the inner loop portion and the one or more turns of the outer loop portion are arranged to turn in the same sense either in a clockwise or an anti-clockwise direction. However, in an alternative embodiment of the first aspect, the one or more turns of the inner loop portion and the one or more turns of the outer loop portion are arranged to turn in the opposite sense, one in a clockwise and the other in an anti-clockwise direction.

In one embodiment of the first aspect, a separation between an outer most turn of the inner loop portion and an inner most turn of the outer loop portion is larger than a separation between adjacent turns of the inner loop portion.

In one embodiment of the first aspect, a separation between an outer most turn of the inner loop portion and an inner most turn of the outer loop portion is larger than a separation between adjacent turns of the outer loop portion.

In one embodiment of the first aspect, the one or more turns of the inner loop portion and the one or more turns of the outer loop portion are formed by a continuous conductive metallic line.

In one embodiment of the first aspect, the integrated circuit chip is arranged exterior to the outer loop portion. In another embodiment of the first aspect, the integrated circuit chip is arranged between the inner loop portion and the outer loop portion. In yet another embodiment of the first aspect, the integrated circuit chip is arranged inside the inner loop portion.

In one embodiment of the first aspect, the antenna and the integrated circuit chip is formed on an inlay.

In one embodiment of the first aspect, the NFC tag further comprises at least one further loop portion arranged inside the inner loop portion or between the inner loop portion and the outer loop portion; the further loop portion being coupled with the inner loop portion or the outer loop portion through a further joining portion, and includes one or more turns.

In one embodiment of the first aspect, the NFC tag further comprises at least capacitor element coupled with the integrated circuit chip to facilitate tuning of a resonance frequency of the tag.

In accordance with a second aspect of the present invention, there is provided a method for operating a near field communication (NFC) tag in accordance with the first aspect of the present invention, the method comprises the steps of: attaching the NFC tag to a first object, wherein the integrated circuit chip of the NFC tag includes information associated with the first object; reading the information associated with the first object using a NFC tag reading module; transmitting from the NFC tag reading module to another party a request for service and the information associated with the first object through a local or remote server; and delivering the service requested from the other party to a place or person based on the request for service and the information associated with the first object.

In one embodiment of the second aspect, the information associated with the first object includes information associated with a position of the first object.

In one embodiment of the second aspect, the place of which the service is delivered to is the position of the first object.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1:
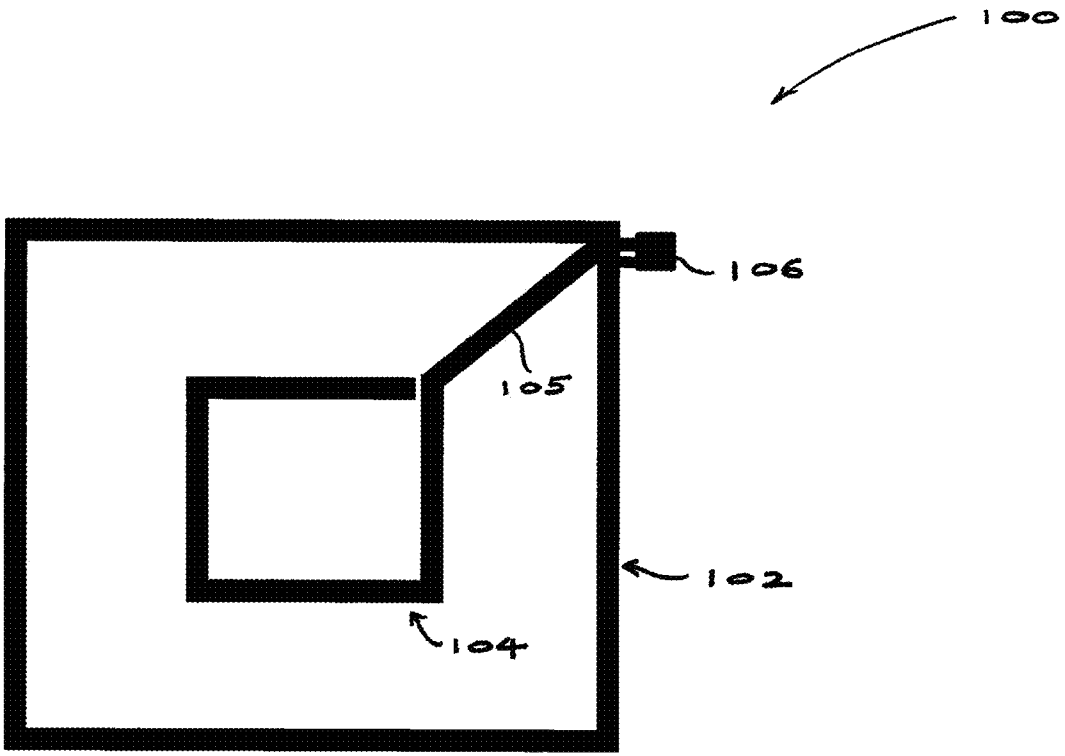
FIG. 1 is a NFC tag in accordance with one embodiment of the present invention.

Referring to FIG. 1, there is provided a near field communication (NFC) tag comprising an antenna having an inner loop portion coupled with an outer loop portion, and an integrated circuit chip attached to the inner loop portion or outer loop portion of the antenna; wherein the inner and outer loop portions of the antenna are arranged to increase a coupling range of the tag with an external tag reader.

Figure 2:
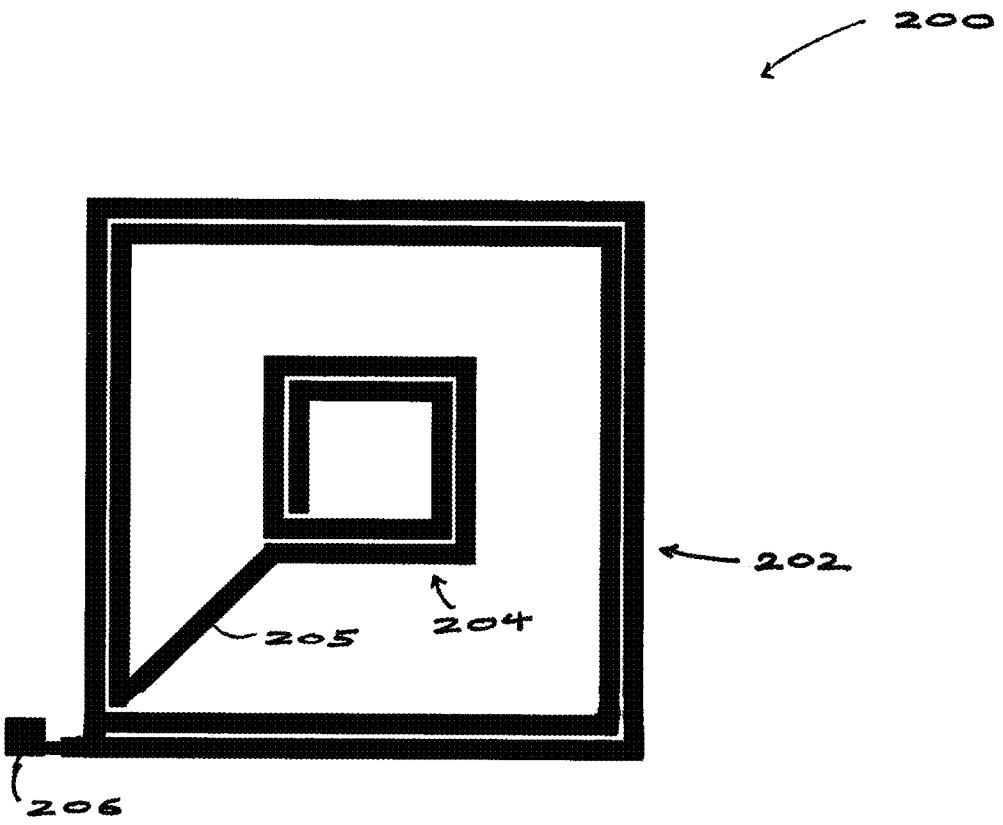
FIG. 2 is a NFC tag in accordance with another embodiment of the present invention.

FIG. 1 shows an embodiment of a NFC tag 100 of the present invention. As shown in the Figure, the tag 100 includes an antenna having an outer loop portion 102 with one turn and an inner loop portion 104 with one turn. The inner and outer loop portions 102, 104 are joined together by a joining section 105. Preferably, the outer loop portion 102, the inner loop portion 104 and the joining section 105 are formed from or so joined to become a continuous strip of conductive material. In the present embodiment, the inner loop portion 104 includes one turn and the outer loop portion 102 includes one turn. Also, the turn of the inner loop portion 104 and the turn of the outer loop portion 102 are both arranged in an anti-clockwise sense as shown. Coupled with the antenna at the outer loop portion 102 is an integrated circuit chip 106 for storing information. Although not specifically shown in FIG. 1, the antenna and the integrated circuit chip 106 are arranged on an inlay, which may be made of a plastic, ceramic or paper material. FIG. 2 shows another embodiment of a NFC tag 200 of the present invention. The basic construction of the tag in FIG. 2 is largely the same as that in FIG. 1, except that in the present embodiment the number of turns of the inner loop portion 204 and the outer loop portion 202 is larger than one. A separation distance between the inner loop portion 204 and the outer loop portion 202 (i.e. the distance between the outermost turn in the inner loop portion 204 and the innermost turn in the outer loop portion 202) is substantially larger than a distance between adjacent turns in the inner loop portion 204 or adjacent turns in the outer loop portion 202. In this embodiment, the inner and outer loop portions 202, 204 are arranged both in a clockwise direction. An integrated circuit chip 206 is coupled with the outer loop portion 202 at a position exterior to the outer loop portion. Although not specifically shown in FIG. 2, the antenna and the integrated circuit chip 206 are arranged on an inlay, which may be made of a plastic, ceramic or paper material.

It should be noted that FIGS. 1 and 2 only shows a front view of the NFC tags 100, 200. A person skilled in the art would appreciate that with regards to the joining section, the entire coil arrangement has to form a closed loop and thus in addition to joining section 105, 205 as shown (which is arranged on top of the substrate), another joining section (not shown) under the substrate is required to close the circuit with the chip. Preferably, this arrangement is used when there are multiple turns in the outer loop portion in order to prevent crossing.

In one preferred embodiment of the present invention, one or more capacitance elements may be added either in series or in parallel to the integrated circuit chip for tuning the inductance of the tag. This arrangement is particularly advantageous when the length of the coils in the inner or outer loop portions, or any other further loop portions, fails to form an optimum LC resonance condition (e.g. frequency) with the capacitance of the chip. In other words, this arrangement can provide an additional flexibility of LC resonance tuning in the tag.

The basic operation principle of the NFC tags 100, 200 in the above embodiments of the present invention is based fundamentally on the theory of superposition. In particular, by having an inner and outer loop portions arrangement, the electromagnetic communication signal (e.g. magnetic field) provided by the outer loop portion can be substantially altered by the presence of the inner loop portion. In the absence of the inner loop portion, the outer loop portion turning in an anti-clockwise sense is operable to generate an electromagnetic signal (for coupling) that has a positive value within the outer loop portion, and a negative value exterior to the outer loop portion (e.g. positive may indicate, for example, out of the paper and negative may indicate, for example, into the paper of FIGS. 1 and 2). If an inner loop portion turning in an anti-clockwise sense is now coupled with the outer loop portion and arranged inside the outer loop portion, the inner loop portion itself would also generate a positive value within the inner loop portion, and a negative value exterior to the inner loop portion (e.g. positive may indicate, for example, out of the paper and negative may indicate, for example, into the paper of FIGS. 1 and 2). As a result, the original electromagnetic signal is altered by the presence of the inner loop portion in the following manner: for the area between the inner and outer loop portions, the original electromagnetic signals by the outer loop portion will be suppressed; whereas for the area within the inner loop portions, the electromagnetic signals of the outer and inner loop portions add up by the superposition principle. As a result, the electromagnetic coupling range of the tag is substantially increased. In other words, the reading distance and/or reading area of the NFC tag are substantially improved in 2D or 3D.

A person skilled in the art would readily appreciate that present invention is capable of various modifications without departing from this fundamental superposition principle. In some embodiments, the inner and outer loop portions can each have one or more number of turns, and the number of turns need not be the same. Furthermore, the turns in the inner and outer loop portions may be clockwise or anti-clockwise, and they do not necessarily both be in clockwise or both be in anti-clockwise. In one example where the turns in the inner loop portion and the turns in the outer loop portion are turning in different senses, the resulting effect would be that the electromagnetic signal between the inner and outer loop portions would be enhanced whereas the electromagnetic signal in the inner loop portion would be suppressed, compared to having only the outer loop portion. The position of the integrated circuit chip is also arbitrary and can be in any position of the tag as long as it is coupled with the antenna. For example, the integrated circuit chip may be arranged inside the inner loop portion, in between the inner and outer loop portion, or outside the outer loop portion. Preferably in some embodiments, the inner and outer loop portions and the joining section are formed from or are made into a continuous piece of conductive material. The shape of the turn(s) in the inner and outer loop portions can also be altered, depending on the desired electromagnetic coupling range and applications. For example, the turns may be of any regular or irregular shape, such as quadrilateral, circular, etc. A person skilled in the art would also appreciate that the NFC tag may comprise at least one further loop portion arranged inside the outer loop portion, or the inner loop portion, or between the inner loop portion and the outer loop portion. Preferably, the further loop portion is coupled with the inner loop portion or the outer loop portion through a further joining portion and includes one or more turns. The operation principles of this further loop portion is substantially the same as the inner/outer loop portions described above, and can be arranged to further optimize the coupling range of the tag.

Figure 3:
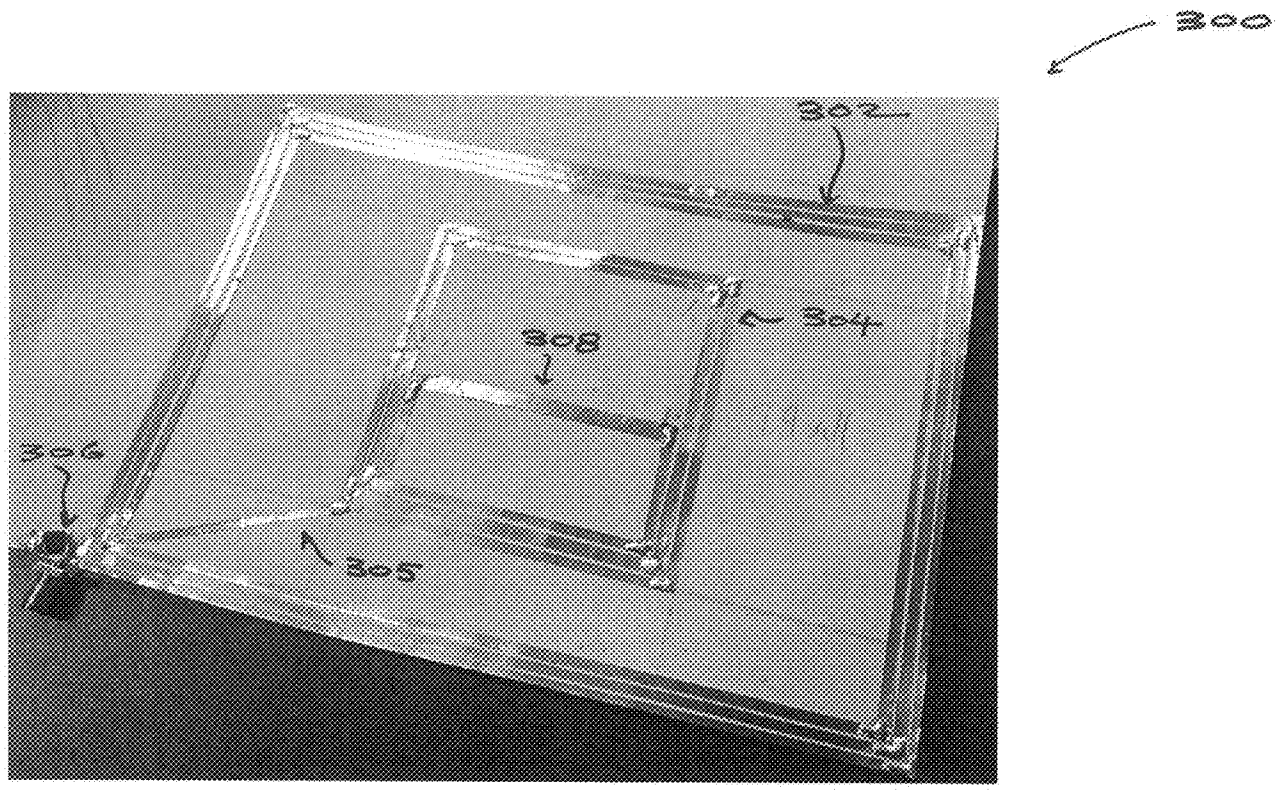
FIG. 3 shows a NFC tag fabricated in accordance with an embodiment of the present invention.

FIG. 3 shows a picture of a fabricated NFC tag 300 in accordance with one embodiment of the present invention. The structure of the fabricated NFC tag 300 has a structure largely the same as that described with reference to FIGS. 1 and 2, and they include the inner loop portion 304, the outer loop portion 302, the joining portion 305, and the integrated circuit chip 306. Compared with the embodiments in FIGS. 1 and 2, the only difference to the fabricated tag 300 in FIG. 3 is that inside the inner loop portion 304 there is formed another loop portion 308. A person skilled in the art would appreciate that the operation principles will remain unchanged by this additional loop 308. The present embodiment shows that the NFC tag antenna of the present invention is capable of having more than two loop portions, although the number of additional loops and the shape of the loops would influence the resultant electromagnetic coupling range of the tag. In the present example, the NFC tag 300 has a size of 5"×7", which is larger in size than conventional NFC tag which is around 2"×3". Also, in this example, another joining portion is arranged beneath the substrate to complete/close the circuit.

Figure 4:
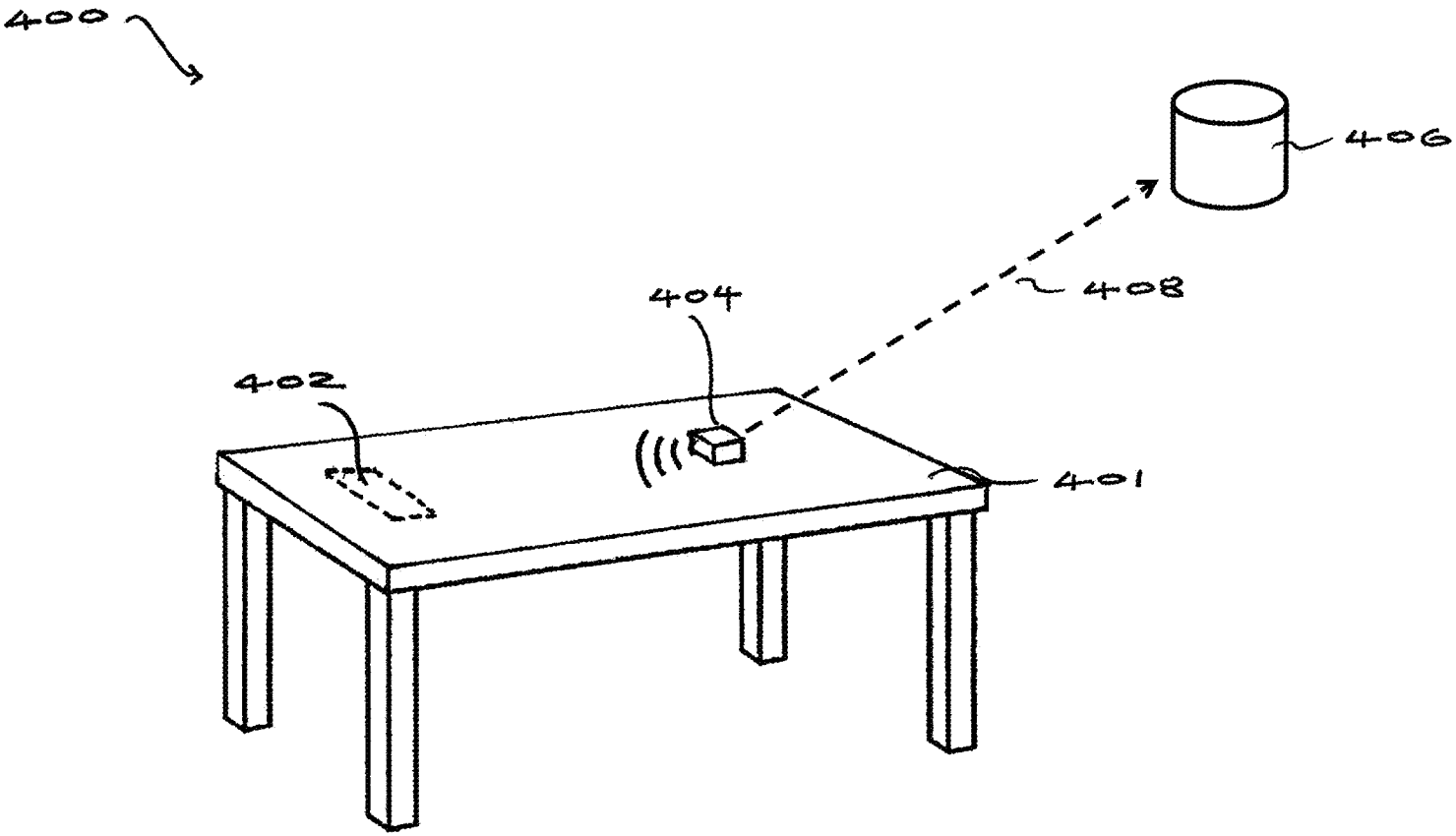
FIG. 4 illustrates an application of the NFC tag in accordance with one embodiment of the present invention.

Referring now to FIG. 4, there is provided a method for operating a near field communication (NFC) tag in accordance with any one of the preceding claims, comprising the steps of: attaching the NFC tag to a first object, wherein the integrated circuit chip of the NFC tag includes information associated with the first object; reading the information associated with the first object using a NFC tag reading module; transmitting from the NFC tag reading module to another party a request for service and the information associated with the first object through a local or remote server; and delivering the service requested from the other party to a place or person based on the request for service and the information associated with the first object.

FIG. 4 shows an application of the NFC tag in accordance with one embodiment of the present invention. Specifically, the application relates to food ordering in a cafeteria 400. In this application, each of the table 401 in the cafeteria is attached with an NFC tag 402 of the present invention. In some other applications, each table may be attached with more than one tag. Information associated with a table 401 is stored in the integrated circuit chip of the NFC tag attached to the table 401. Such information may include a position of the table in the cafeteria or an identification number of the table. A user may place an order for food or service by using a NFC reading electronic device 404, such as his own mobile phone. Alternatively, the user may also use a reader (e.g. include input/output module and display) provided by the cafeteria to place an order for food or service. Preferably, the mobile phone has other communication functions and a software application for ordering food preinstalled in the phone. To order food, the user will only need to sit down at a table 401 in the cafeteria and do the ordering. In particular, the user may select the food or service to order from the menu provided by the software application loaded in the phone 404. Meanwhile, the phone 404 (with NFC reading function) will communicate with the NFC tag 402 embedded in or attached to the table 401 to retrieve information relating to the table 401. Specifically, the phone will communicate power signal and read command to the NFC tag 402 so as to retrieve the information from the tag 402. Upon finalizing the food or service to order, the user sends the order, together with the information retrieved from the NFC tag 402 in the table 401, to a remote or local server 406 through a wireless communication signal using a wireless communication link 408 (e.g. a WiFi, cellular, Bluetooth network). In one example, the remote or local server 406 is arranged to relay the information to the kitchen of the cafeteria, so that the staff can receive the order from the user without having to take order from the user directly. Once the food or service has been prepared and is ready to serve, the staff can then deliver the ordered food or service to the user at a specific table 402 based on the information of the table received. In another example, the NFC reading module 404 may be provided by the cafeteria in the form of a portable electronic device.

A person skilled in the art would readily appreciate that other applications (other than applications in the food industry for food ordering) are also possible with the NFC tag of the present invention.

The NFC tags in the embodiments for the present invention are particularly advantageous by virtue of its antenna having an inner and outer loop portions structure. In particular, by providing an antenna with inner and outer loop portions structure, the coupling range and the coverage of the NFC tag can be substantially increased, especially when compared to the design of simply enlarging the NFC tag. The coupling range and the coverage of the tag may be adjusted by tailor making the different antenna loops to best suit different applications. The application of the NFC tag is also advantageous as it provides a cheap and effective solution for ordering in the food industry, without having to redesign the infrastructure of the place of business. Specifically, the NFC tag provides the ability to preserve existing infrastructure during the NFC technology implementation process. The increase in coverage and penetration power due to the tag design can allow implementation to be hidden (i.e., under a table at shown in embodiment of FIG. 4) which has aesthetic and functional appeal. The implementation with existing conventional NFC tag, i.e. placing the NFC tag under a table (made of granite, or other stone material), would not be possible as the conventional NFC tag lacks the penetration power of the present invention. Other advantages of the present invention in terms of costs, function, structure, effectiveness, ease of manufacture, etc. would become apparent to a person skilled in the art by reference to the above description.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A near field communication (NFC) tag comprising:

a substrate;

an antenna having an outer loop portion with multiple turns, an inner loop portion with one or more turns, the inner loop portion being spaced apart from and coupled with the outer loop portion, a first joining portion connecting the inner loop portion with the outer loop portion, and a second joining portion connecting the inner loop portion with the outer loop portion, wherein the inner loop portion, the first joining portion, and the outer loop portion being formed by a continuous conductive metallic line and being arranged on top of the substrate, and wherein the second joining portion being arranged under the substrate to prevent crossing;

an integrated circuit chip attached to the outer loop portion and arranged exterior to the outer loop portion; and a capacitor element connected in series or in parallel with the integrated circuit chip to facilitate tuning of a resonance frequency of the NFC tag; wherein the inner loop portion, the outer loop portion, the first joining portion, and the second joining portion form a closed loop with the integrated circuit chip; and wherein the inner loop portion and the outer loop portion determine an electromagnetic coupling range of the NFC tag with an external NFC tag reader.

2. The NFC tag in accordance with claim 1, wherein the one or more turns of the inner loop portion and the turns of the outer loop portion are arranged to turn in the same sense either in a clockwise or an anti-clockwise direction.

3. The NFC tag in accordance with claim 1, wherein the one or more turns of the inner loop portion and the turns of the outer loop portion are arranged to turn in the opposite sense, one in a clockwise and the other in an anti-clockwise direction.

4. The NFC tag in accordance with claim 1, wherein the inner loop portion has multiple turns and a separation between an outer-most turn of the inner loop portion and an inner-most turn of the outer loop portion is larger than a separation between adjacent turns of the inner loop portion.

5. The NFC tag in accordance with claim 1, wherein the inner loop portion has multiple turns and a separation between an outer-most turn of the inner loop portion and an inner-most turn of the outer loop portion is larger than a separation between adjacent turns of the outer loop portion.

6. The NFC tag in accordance with claim 1, wherein the antenna and the integrated circuit chip are formed on an inlay.

7. The NFC tag in accordance with claim 1, further comprising at least one further loop portion arranged inside the outer loop portion, or the inner loop portion, or between the inner loop portion and the outer loop portion; the further loop portion being arranged on the top of the substrate and coupled with the inner loop portion or the outer loop portion through a further joining portion arranged on the top of the substrate, and includes one or more turns.

8. The NFC tag in accordance with claim 1, wherein the inner loop portion is arranged centrally within the outer loop portion.

9. The NFC tag in accordance with claim 1, wherein the inner loop portion is generally rectangular and the outer loop portion is generally rectangular.

10. The NFC tag in accordance with claim 9, wherein the first joining portion is straight.

11. The NFC tag in accordance with claim 10, wherein the inner loop portion has multiple turns, and wherein a separation between an outer-most turn of the inner loop portion and an inner-most turn of the outer loop portion is larger than a separation between adjacent turns of the inner loop portion, and larger than a separation between adjacent turns of the outer loop portion.

* * * * *